US010475615B2

(12) United States Patent
Okamura et al.

(10) Patent No.: US 10,475,615 B2
(45) Date of Patent: Nov. 12, 2019

(54) PRODUCTION METHOD OF NEGATIVE ELECTRODE, NEGATIVE ELECTRODE, AND X-RAY TUBE DEVICE

(71) Applicant: Shimadzu Corporation, Kyoto (JP)

(72) Inventors: Shinichiro Okamura, Kyoto (JP); Atsushi Yajima, Kyoto (JP)

(73) Assignee: Shimadzu Corporation, Nakagyo-ku, Kyoto-shi, Kyoto (JP)

( * ) Notice: Subject to any disclaimer, the term of this patent is extended or adjusted under 35 U.S.C. 154(b) by 161 days.

(21) Appl. No.: 15/892,154

(22) Filed: Feb. 8, 2018

(65) Prior Publication Data

US 2019/0244781 A1 Aug. 8, 2019

(51) Int. Cl.

| | |
|---|---|
| ***H01J 1/16*** | (2006.01) |
| ***H01J 35/06*** | (2006.01) |
| ***H01B 1/00*** | (2006.01) |

(52) U.S. Cl.

CPC ..... *H01J 1/16* (2013.01); *H01J 35/06* (2013.01)

(58) Field of Classification Search

CPC .... H01J 1/16; H01J 35/06; H01B 1/00; H01L 35/00; H01L 35/22

See application file for complete search history.

(56) References Cited

U.S. PATENT DOCUMENTS

| | | | | |
|---|---|---|---|---|
| 6,115,453 | A | 9/2000 | Hell et al. | |
| 2014/0360546 | A1* | 12/2014 | Reifenberg | H01L 35/22 136/201 |
| 2015/0262782 | A1 | 9/2015 | Kobayashi et al. | |

FOREIGN PATENT DOCUMENTS

| | | | |
|---|---|---|---|
| JP | H06-005201 | A | 1/1994 |
| JP | 2002-093318 | A | 3/2002 |
| JP | 2011-040272 | A | 2/2011 |
| JP | 2014-175197 | A | 9/2014 |
| JP | 2014-229388 | A | 12/2014 |
| WO | WO2014/041639 | A1 | 3/2014 |

OTHER PUBLICATIONS

Office Action dated Sep. 4, 2018 for corresponding Japanese Patent Application No. 2015-151551.

* cited by examiner

*Primary Examiner* — David P Porta
*Assistant Examiner* — Fani Boosalis
(74) *Attorney, Agent, or Firm* — Muir Patent Law, PLLC

(57) ABSTRACT

This method of producing a negative electrode includes a step of adjusting a heat transfer coefficient between a leg portion and a fixing portion so that at least one of leg portions and the other leg portions become different in the heat transfer coefficient by deforming the plurality of fixing portions by applying pressure to the plurality of fixing portions from the outside thereof to fix the leg portions to the fixing portions.

3 Claims, 6 Drawing Sheets

First (Second) Embodiments

First to Fourth Embodiments

First (Second) Embodiments

| Pressure | Current [A] | Voltage [V] | Temperature at the Point A [K] | Temperature at the Point B ]K] | Temperature difference [K] |
|---|---|---|---|---|---|
| 0.4 MPa | 15 | 2.29 | 1,960 | 1,381 | 579 |
| 0.6 MPa | 21 | 4.22 | 1,932 | 1,682 | 250 |

Third Embodiment

Fourth Embodiment

PRODUCTION METHOD OF NEGATIVE ELECTRODE, NEGATIVE ELECTRODE, AND X-RAY TUBE DEVICE

CROSS-REFERENCE TO RELATED APPLICATIONS

The present application relates to Japanese Patent Application No. 2015-151551, entitled "Production Method of Negative Electrode, Negative Electrode, and X-ray Tube Device," filed on Jul. 31, 2015, and invented by Shinichiro Okamura and Atsushi Yajima, the contents of which are hereby incorporated by reference in their entirety.

BACKGROUND OF THE INVENTION

Field of the Invention

The present invention relates to a method of producing a negative electrode, a negative electrode, and an X-ray tube device.

Background Technique

Conventionally, a negative electrode equipped with an electron emitting portion configured to emit electrons by electric heating is known. Such a negative electrode is disclosed in, for example, U.S. Pat. No. 6,115,453.

Conventionally, a negative electrode equipped with a metallic emitter (electron emitting portion) for emitting electrons by electric heating and terminals for energizing the emitter is known. Here, it is known that an evaporation amount of metal increases exponentially with respect to the temperature.

In a conventional emitter that emits electrons by electric heating, in cases where there is a deviation of a temperature distribution of a surface that emits electrons (hereinafter referred to as "electron emitting surface") of the emitter, when the emitter is energized (at the initial stage), in a relatively high temperature region among the electron emission surface, the evaporation amount of the metal constituting the emitter is larger as compared with a relatively low temperature region. As a result, the plate thickness of the emitter in the relatively high temperature region of the electron emission surface decreases, so that the current density increases, which in turn further increases the evaporation amount.

That is, at the initial stage, when there is a deviation of a temperature distribution of the electron emission surface of the emitter, the temperature rises at an accelerated rate in the relatively high temperature region of the electron emission surface as compared with the relatively low temperature region. As a result, the relatively high temperature region of the electron emission surface is disconnected, so that the emitter becomes unusable (it reaches the end of its lifetime). In other words, at the initial stage, by reducing the deviation of the temperature distribution of the electron emission surface of the emitter, it is possible to extend the lifetime of the emitter.

Under the circumstances, in the negative electrode described in U.S. Pat. No. 6,115,453, a slit is formed in an emitter, so that a current path of a serpentine shape (meander shape) is formed in the emitter. With this, the cross-sectional area of the flow path through which the current flows becomes relatively small.

Here, in cases where a cross-sectional area of a path through which a current flows is relatively large, a difference (temperature difference) in the amount of heat generation occurs between the vicinity of the center portion of the path where the amount of flowing current is large and the vicinity of the outer edge portion where the amount of flowing current is small. Considering this point, by forming a current path of a serpentine shape (meander shape) in an emitter to make a cross-sectional area of the current flowing path relatively small, the deviation of the temperature distribution of the electron emission surface of the emitter can be reduced.

Further, in the negative electrode described in U.S. Pat. No. 6,115,453, a pair of plate-shaped terminals for energizing the emitter is provided. And it is configured such that the width (cross-sectional area) of the plate-shaped terminal is made relatively small to reduce the deviation of the temperature distribution of the electron emission surface of the emitter when the emitter is energized (at the initial stage).

Further, in the negative electrode described in U.S. Pat. No. 6,115,453, a pair of plate-shaped terminals is welded to electrodes for supplying a current. Here, in the case of welding the pair of plate-shaped terminals to the electrodes, the materials of the terminals and the materials of the electrodes are limited. That is, depending on the material of the terminal and the material of the electrode, welding cannot be performed in some cases.

Under the circumstances, conventionally, there has been proposed a method of fixing a pair of plate-shaped terminals to electrodes by deforming the electrodes by applying pressure to the electrodes from the outside in a state in which a pair of plate-shaped terminals is inserted in the electrodes. In this conventionally proposed fixing method, it is possible to fix a pair of plate-shaped terminals to electrodes irrespective of the materials of terminals and materials of the electrodes. That is, it becomes possible to diversify the kinds of usable electrode materials.

If a method of fixing a pair of plate-shaped terminals each having a small cross-sectional area to electrodes is applied to the negative electrode disclosed in U.S. Pat. No. 6,115,453 by applying pressure to a conventionally suggested electrode, it is possible to reduce the deviation of the temperature distribution of an electron emission surface of an emitter while diversifying the kinds of usable electrode parts. However, there are limitations in devising the shape of an emitter (electron emitting portion) such as forming a meander-shaped current path and in reducing the cross-sectional area of the plate-shaped terminal (leg portion).

SUMMARY OF THE INVENTION

The present invention was made to solve the above problems, and an object of the present invention is to provide a method of producing a negative electrode, a negative electrode, and an X-ray tube device, which are capable of adjusting a temperature distribution of an electron emitting portion.

In order to achieve the aforementioned object, a method of producing a negative electrode according to a first aspect of the present invention is a method of producing a negative electrode in which a plurality of leg portions extending from an electron emitting portion for emitting electrons by electric heating is fixed to a plurality of metallic fixing portions. The method includes: a step of inserting the leg portions into recesses of the fixing portions; and a step of adjusting a heat transfer coefficient between the leg portion and the fixing portion so as to be differentiated between at least one of the leg portions and the other leg portions by deforming the plurality of fixing portions by applying pressure to the plurality of fixing portions from outside thereof so that pressure with respect to at least one of the leg portions becomes different from pressure with respect to the other leg portions to fix the leg portions to the fixing portions.

With this, it possible to adjust the temperature distribution of the electron emitting portion. For example, the deviation of the temperature distribution can be reduced.

In the method of producing a negative electrode according to the first aspect of the present invention, preferably, the step of adjusting the heat transfer coefficient between the leg portion and the fixing portion includes a step of adjusting the heat transfer coefficient between the leg portion and the fixing portion so that pressure with respect to the leg portion extending from a vicinity of the electron emitting portion relatively high in temperature becomes larger than pressure with respect to the leg portion extending from a vicinity of a portion of the electron emitting portion relatively low in temperature in a temperature distribution of the electron emitting portion before inserting the leg portions into the recesses of the fixing portions.

With this, the temperature of the portion of the electron emitting portion having a relatively high temperature can be lowered, which in turn can reduce the deviation of the temperature distribution of the electron emitting portion.

In the method of producing a negative electrode according to the first aspect of the present invention, preferably, the step of adjusting the heat transfer coefficient between the leg portion and the fixing portion further includes, in addition to differentiating the pressure with respect to the at least one of the leg portions from the pressure with respect to the other leg portions, a step of adjusting a heat transfer coefficient between the leg portion and the fixing portion by fixing the leg portions to the plurality of fixing portions in which the at least one of the fixing portions is differentiated in material from the other fixing portions.

In the method of producing a negative electrode according to the first aspect of the present invention, preferably, at least one of the fixing portions is differentiated in shape from the other fixing portions.

A method of producing a negative electrode according to a second aspect of the present invention is a method of producing a negative electrode in which a plurality of leg portions extending from an electron emitting portion for emitting electrons by electric heating is fixed to a plurality of metallic fixing portions. The method includes: a step of inserting the leg portions into recesses of the fixing portions; and a step of adjusting the heat transfer coefficient between the leg portion and the fixing portion so as to be differentiated between at least one of the fixing portions and the other fixing portions by fixing the leg portions to the plurality of fixing portions in which at least one of the fixing portions is differentiated in material from the other fixing portions.

With this, it possible to adjust the temperature distribution of the electron emitting portion. For example, the deviation of the temperature distribution can be reduced.

In the method of producing a negative electrode according to the second aspect of the present invention, preferably, the step of adjusting the heat transfer coefficient between the leg portion and the fixing portion includes a step of adjusting the heat transfer coefficient between the leg portion and the fixing portion by selecting materials of the fixing portions so that the heat transfer coefficient of the fixing portion with respect to the leg portion extending from the vicinity of the electron emitting portion relatively high in temperature is greater than the heat transfer coefficient of the fixing portion with respect to the leg portion extending from the vicinity of the portion of the electron emitting portion relatively low in temperature in a temperature distribution of the electron emitting portion before inserting the leg portions into the recesses of the fixing portions.

With this, the temperature of the portion of the electron emitting portion having a relatively high temperature can be lowered, which in turn can reduce the deviation of the temperature distribution of the electron emitting portion.

A negative electrode according to a third aspect of the present invention includes: an electron emitting portion configured to emit electrons by electric heating; a plurality of leg portions extending from the electron emitting portion; and a plurality of metallic fixing portions each having a recess into which the leg portion is inserted and joined, wherein a joint strength of at least one of the leg portions with respect to the fixing portion is different from joint strengths of the other leg portions with respect to the fixing portions, and at least one of the leg portions and the other leg portions are different in heat transfer coefficient between the leg portion, and the fixing portion.

A negative electrode according to a fourth aspect includes an electron emitting portion configured to emit electrons by electric heating, a plurality of leg portions each extending from the electron emitting portion, and a plurality of metallic fixing portions each having a recess into which the leg portion is inserted and joined. At least one of the fixing portions is different in material from the other fixing portions, and one of the fixing portions and the other fixing portions is different in heat transfer coefficient between the leg portion and the fixing portion.

An X-ray tube device according to a fifth aspect of the present invention includes a positive electrode and a negative electrode. The negative electrode includes a plurality of leg portions each extending from an electron emitting portion and a plurality of metallic fixing portions each having a recess into which the leg portion is inserted and joined. At least one of the fixing portions is different in material from the other fixing portions, and one of the fixing portions and the other fixing portions are different in heat transfer coefficient between the leg portion and the fixing portion.

DESCRIPTION OF PREFERRED EMBODIMENTS

Hereinafter, embodiments embodying the present invention will be described with reference to the drawings.

First Embodiment (Configuration of X-Ray Tube Device)

First, a configuration of the X-ray tube device 100 according to a first embodiment of the present invention will be described with reference to FIG. 1.

Figure 1:
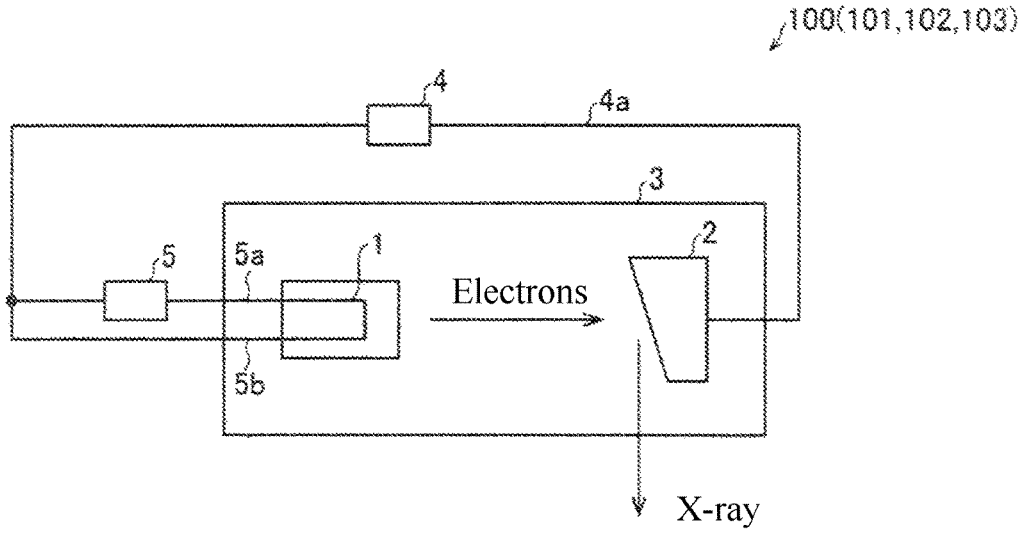
FIG. 1 is a block diagram showing an outline of an X-ray tube device according to first to fourth embodiments of the present invention.

As shown in FIG. 1, the X-ray tube device 100 is configured to generate X-rays. Further, the X-ray tube device 100 is equipped with a negative electrode 1 for generating an electron beam, a positive electrode 2, a container 3 accommodating the negative electrode 1 and the positive electrode 2 therein, and power supply circuits 4 and 5.

The negative electrode 1 is configured to emit electrons toward the positive electrode 2. The negative electrode 1 is arranged so as to face the positive electrode 2. Further, it is configured to apply a predetermined voltage by the power supply circuit 4 between the negative electrode 1 and the positive electrode 2. Specifically, it is configured such that the negative electrode 1 and the positive electrode 2 are connected to the power supply circuit 4 via wiring 4*a* and a voltage relatively positive with respect to the negative electrode 1 is applied to the positive electrode 2. Further, the negative electrode 1 is connected to the power supply circuit 5 via wiring 5*a* and 5*b*. The negative electrode 1 is configured to be heated by being energized by the power supply circuit 5. With this, an electron beam (thermoelectron) emitted from the negative electrode 1 toward the positive electrode 2 is generated.

The positive electrode 2 is made of metal. For example, the positive electrode 2 is made of a metal material, such as, e.g., copper, molybdenum, cobalt, chromium, iron, and silver. The positive electrode 2 generates an X-ray when an electron beam (thermoelectron) emitted from the negative electrode 1 collides.

Inside the container 3, the negative electrode 1 and the positive electrode 2 are arranged. The inside of the container 3 is vacuumed. The container 3 is made of a nonmagnetic metal material, such as, e.g., stainless steel (SUS). Further, the container 3 is provided with a window part for releasing X-rays to the outside.

(Configuration of Negative Electrode)

Figure 2:
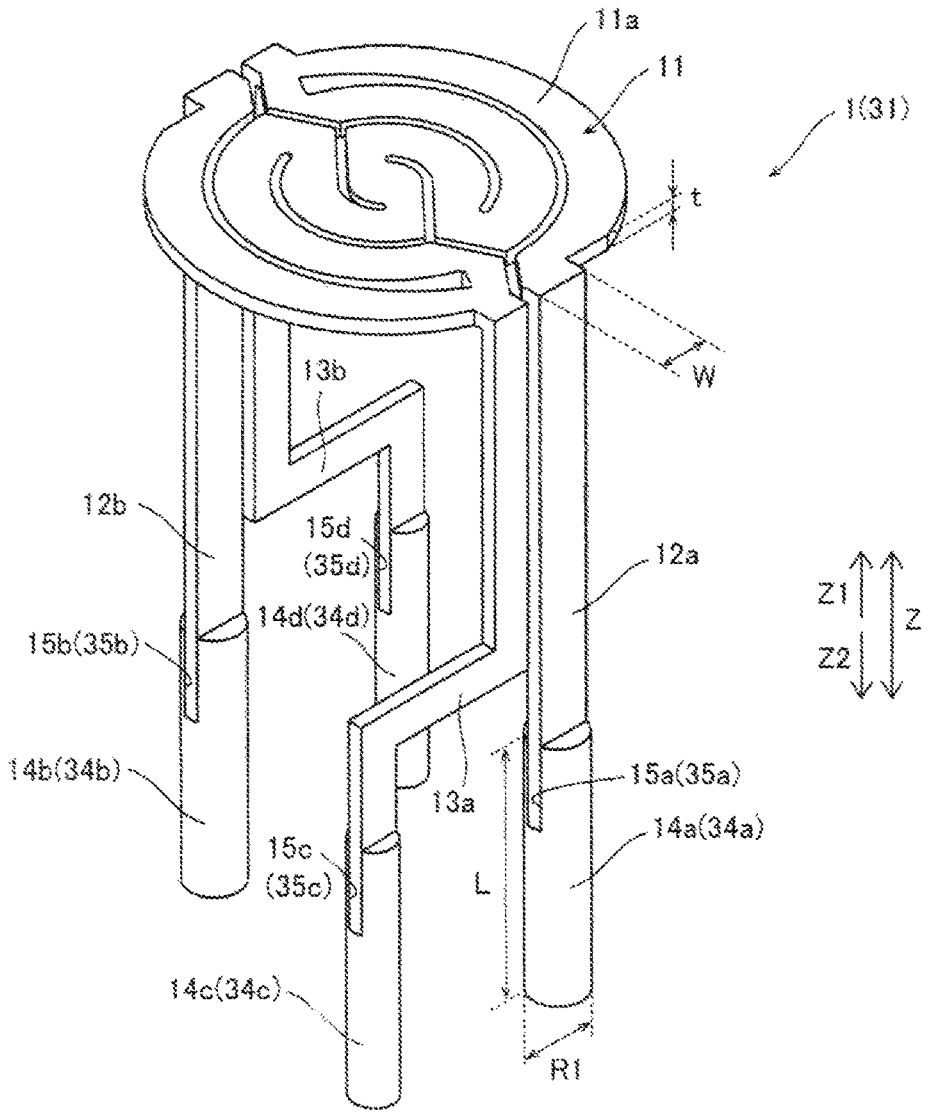
FIG. 2 is a perspective view of a negative electrode according to the first and second embodiments of the present invention.

Next, the structure of the negative electrode 1 will be described in detail. As shown in FIG. 2, the negative electrode 1 is made of pure tungsten or a tungsten alloy, and is integrally provided with a flat electron emitting portion 11, a pair of a terminal leg portion 12*a* and a terminal leg portion 12*b*, and a pair of a supporting leg portion 13*a* and a supporting leg portion 13*b*. That is, the electron emitting portion 11, the terminal leg portions 12*a* and 12*b*, and the supporting leg portions 13*a* and 13*b* are integrally formed by the same member. Note that the terminal leg portions 12*a* and 12*b* and the supporting leg portions 13*a* and 13*b* each are an example of the "leg portion" recited in claims.

The negative electrode 1 is a so-called thermoelectron emission type emitter, and is configured to be heated by being energized via the pair of terminal leg portions 12*a* and 12*b*. With this, when the flat electron emitting portion 11 is electrically heated to a predetermined temperature (about 2,400 K to about 2,700 K) with a predetermined current, electrons are emitted from the electron emitting portion 11.

The negative electrode 1 is covered with a metallic cover (not shown). The terminal leg portions 12*a* and 12*b* and the supporting leg portions 13*a* and 13*b* are fixed to respective fixing portions 14*a* to 14*d*. To the fixing portions 14*a* and 14*b* to which the terminal leg portions 12*a* and 12*b* are fixed, wiring 5*a* and 5*b* (see FIG. 1) are connected, respectively. Note that the fixing portions 14*c* and 14*d* to which the supporting leg portions 13*a* and 13*b* are fixed are not connected to wiring and are in an electrically floating state (floating state).

As shown in FIG. 2, the electron emitting portion 11 is formed in a flat plate shape by a current path 11*a* of a serpentine shape (meander shape). The electron emitting portion 11 is formed in a substantially circular shape in a plan view (as viewed from the Z direction).

As shown in FIG. 2, the current path 11*a* is formed to have a substantially constant path width W. The current path 11*a* is formed in a flat plate shape having a substantially constant thickness t. Both ends of the current path 11*a* are connected to the terminal leg portions 12*a* and 12*b*, respectively. The current path 11*a* is formed to be substantially point symmetrical in a plan view.

Further, the pair of terminal leg portions 12*a* and 12*b* are formed by extending from the electron emitting portion 11 and being bent in a Z2 direction. One ends of the terminal leg portions 12*a* and 12*b* are connected to end portions of the current path 11*a* (electron emitting portion 11), respectively. Also, the other ends of the pair of terminal leg portions 12*a* and 12*b* are connected to the fixing portions 14*a* and 14*b*, respectively. Further, the terminal leg portions 12*a* and 12*b* have substantially the same shape. Specifically, it has a substantially linear plate shape.

The supporting leg portions 13*a* are 13*b* are formed by extending from the electron emitting portion 11 and being bent in the Z2 direction. The supporting leg portions 13*a* and 13*b* are provided separately from the terminal leg portions 12*a* and 12*b* and are formed so as to support the electron emitting portion 11. One ends of the supporting leg portion 13*a* and 13*b* are connected to the electron emitting portion 11 (portions between the ends of the current path 11*a*). The other ends of the supporting leg portions 13*a* and 13*b* are connected to electrically floating fixing portion 14*c* and 14*d*. Further, the supporting leg portions 13*a* and 13*b* have substantially the same shape. Specifically, the supporting leg portions 13*a* and 13*b* each have a bent plate shape.

The fixing portions 14*a* to 14*d* have the same shape. Specifically, the fixing portions 14*a* to 14*d* each have a cylindrical shape (bar shape) extending in the Z direction, and the diameter R1 and the length L are substantially equal to each other. Further, the fixing portions 14*a* to 14*d* are made of metals, such as, e.g., tungsten, rhenium, tantalum, osmium, molybdenum, niobium, iridium, boron, ruthenium, hafnium, alloys using these metals, and stainless steel. In the first embodiment, the fixing portions 14*a* to 14*d* are made of the same material (for example, molybdenum).

The fixing portions 14*a* to 14*d* are provided with recesses 15*a* to 15*d* into which the terminal leg portions 12*a* and 12*b* and the supporting leg portions 13*a* and 13*b* are to be inserted and joined, respectively. Specifically, in the first embodiment, the recesses 15*a* to 15*d* are each formed in a slit shape that penetrates in a direction orthogonal to a direction (Z2 direction) along which the fixing portions 14*a* to 14*d* are inserted.

Here, in the first embodiment, the heat transfer coefficient between the terminal leg portion 12*a*, 12*b* or the supporting leg portion 13*a*, 13*b* and the fixing portion 14*a* to 14*d* is adjusted by making the joint strength of at least one of the terminal leg portions 12*a* and 12*b* and the supporting leg portions 13*a* and 13*b* with respect to a fixing portion (corresponding fixing portion 14*a* to 14*d*) different from joint strengths of the others of the terminal leg portions 12*a* and 12*b* and the supporting leg portions 13*a* and 13*b* with respect to the other fixing portions.

Specifically, in the temperature distribution of the electron emitting portion 11 before inserting the terminal leg portions 12*a* and 12*b* and the supporting leg portions 13*a* and 13*b* into the recesses 15*a* to 15*d* of the fixing portions 14*a* to 14*d*, the heat transfer coefficient between the terminal leg portion, 12*a*, 12*b* or the supporting leg portion 13*a*, 13*b* and the fixing portion 14*a* to 14*d* is adjusted by making the joint strength with respect to the leg portion (terminal leg portion 12*a*, 12*b*, supporting leg portion 13*a*, 13*b*) extending from the vicinity of the portion of the electron emitting portion 11 having a relatively high temperature larger than the joint strength with respect to the leg portion extending from the vicinity of the portion of the electron emitting portion 11 having a relatively low temperature.

For example, in the case in which the vicinities of the portions of the electron emitting portion 11 to which the terminal leg portions 12*a* and 12*b* and the supporting leg portions 13*a* and 13*b* are connected are higher in temperature before being inserted (joined) to the fixing portions 14*a* to 14*d* in the order of the terminal leg portions 12*a* and 12*b* and the supporting leg portions 13*a* and 13*b*, it is configured such that the joint strengths become larger in the order of the terminal leg portions 12*a* and 12*b* and the supporting leg portions 13*a* and 13*b*.

Effects of Structure of First Embodiment

In the first embodiment, the following effects can be obtained.

In the first embodiment, as described above, the metallic fixing portions 14*a* to 14*d* having recesses 15*a* to 15*d* into which the terminal leg portions 12*a* and 12*b* and the supporting leg portions 13*a* and 13*b* are respectively inserted and joined are provided, and the joint strength of at least one of the terminal leg portions 12*a* and 12*b* and the supporting leg portions 13*a* and 13*b* with respect to the corresponding fixing portion is differentiated from the joint strength of the other leg portions with respect to the corresponding fixing portions, so that the heat transfer coefficient between the terminal leg portion 12*a*, 12*b* or the supporting leg portion 13*a*, 13*b* and the fixing portion 14*a* to 14*d* is adjusted.

With this, by differentiating the joint strength (pressure) with respect to the terminal leg portions 12*a* and 12*b* and the supporting leg portions 13*a* and 13*b*, it is possible to differentiate the adhesion (the joint strength of the terminal leg portions 12*a* and 12*b* or the supporting leg portions 13*a* and 13*b* and the fixing portions 14*a* to 14*d*) between the terminal leg portion 12*a*, 12*b* or the supporting leg portion 13*a*, 13*b* and the fixing portion 14*a* to 14*d*.

That is, when viewed microscopically, it is considered that differentiating the joint strength causes a change in the degree of flattening of fine irregularities at the contact interface, causing a change in the joined area, which in turn causes a change in the adhesion (joint strength). With this, the heat transfer coefficient between the terminal leg portion 12*a*, 12*b* or the supporting leg portion 13*a*, 13*b* and the fixing portion 14*a* to 14*d* is adjusted, so that the deviation of the temperature distribution of the electron emitting portion 11 can be reduced.

Regardless of the materials of the terminal leg portions 12*a* and 12*b* and the supporting leg portions 13*a* and 13*b* and the material of the fixing portions 14*a* to 14*d*, it is possible to fix the terminal leg portions 12*a* and 12*b* and the supporting leg portions 13*a* and 13*b* to the fixing portions 14*a* to 14*d*, so that the kinds of materials of the usable fixing portions 14*a* to 14*d* can be diversified. As a result, while diversifying the kinds of materials of the usable fixing portions 14*a* to 14*d*, independently from devising the shape of the electron emitting portion 11 and reducing the cross-sectional areas of the terminal leg portions 12*a* and 12*b* and the supporting leg portions 13*a* and 13*b*, the deviation of the temperature distribution of the electron emitting portion 11 can be reduced.

It has been confirmed by experiments conducted by the inventors which will be described later that it is possible to adjust the heat transfer coefficient between the terminal leg portion 12*a*, 12*b* or the supporting leg portion 13*a*, 13*b* and the fixing portion 14*a* to 14*d* by differentiating the pressure (contact strength) with respect to the terminal leg portion 12*a* and 12*b* and the supporting leg portion 13*a* and 13*b*.

Further, in the first embodiment, as described above, the recess 15*a* to 15*d* of the fixing portion 14*a* to 14*d* is formed in a slit shape penetrating in a direction intersecting with a direction along which the terminal leg portion 12*a*, 12*b* or the supporting leg portion 13*a* and 13*b* is inserted. With this, unlike a recess not penetrating in a direction intersecting with a direction along which the leg portion is inserted, it becomes easy to insert the terminal leg portion 12*a*, 12*b* or the supporting leg portion 13*a*, 13*b* into the recess 15*a* to 15*d* and also becomes easy to deform the fixing portion 14*a* to 14*d*.

(Method of Producing Negative Electrode)

Next, a method of producing the negative electrode 1 will be described.

(Insertion Step of Leg Portion)

First, as shown in FIG. 2, the terminal leg portions 12*a* and 12*b* and the supporting leg portions 13*a* and 13*b* are inserted in the slit-like recesses 15*a* to 15*d* of the plurality of fixing portions 14*a* to 14*d* penetrating in a direction intersecting with a direction (Z direction) along with which the leg portions (terminal leg portions 12*a* and 12*b*, supporting leg portions 13*a* and 13*b*) are inserted.

(Adjustment Step of Heat Transfer Coefficient)

Next, in the first embodiment, the fixing portions 14*a* to 14*d* are deformed by applying pressure to respective fixing portions 14*a* to 14*d* from the outside thereof so that the pressure with respect to at least one of the terminal leg portions 12*a* and 12*b* and the supporting leg portions 13*a* and 13*b* inserted in the respective recesses 15*a* to 15*d* of the fixing portions 14*a* to 14*d* is differentiated from the pressure with respect to the others to thereby fix (swage) the supporting leg portions 13*a* and 13*b* to the respective fixing portions 14*a* to 14*d*.

Specifically, pressure is applied to the fixing portions 14*a* to 14*d* from the outside thereof with a jig (not shown) pressing the fixing portions 14*a* to 14*d* by pressure of air or the like to thereby fix the terminal leg portions 12*a* and 12*b* and the supporting leg portion 13*a* and 13*b* to the fixing portions 14*a* to 14*d*. With this, the heat transfer coefficient between the terminal leg portion 12*a*, 12*b* or the supporting leg portion 13*a*, 13*b* and the fixing portion 14*a* to 14*d* is adjusted.

In detail, in the temperature distribution of the electron emitting portion 11 before inserting the fixing portions 14*a* to 14*d* into the respective recess 15*a* to 15*d* of the fixing portions 14*a* to 14*d*, the heat transfer coefficient between the terminal leg portion 12*a*, 12*b* or the supporting leg portion 13*a*, 13*b* and the fixing portion 14*a* to 14*d* is adjusted by making the pressure with respect to the leg portion (terminal leg portion 12*a*, 12*b*, supporting leg portion 13*a*, 13*b*) extending from the vicinity of the portion of the electron emitting portion 11 having a relatively high temperature larger than the pressure with respect to the leg portion extending from the vicinity of the portion of the electron emitting portion 11 having a relatively low temperature.

For example, in the case in which the vicinities of the portions of the electron emitting portion 11 to which the terminal leg portions 12*a* and 12*b* and the supporting leg portions 13*a* and 13*b* are connected are higher in temperature in the order of the terminal leg portions 12*a* and 12*b* and the supporting leg portion 13*a* and 13*b*, pressure of A [Pa], B [Pa], C [Pa], D [Pa] (A>B>C>D) are applied from the outside of the respective fixing portions 14*a* to 14*d*. In this way, the terminal leg portions 12*a* and 12*b* and the supporting leg portions 13*a* and 13*b* are fixed to the respective fixing portions 14*a* to 14*d*.

Thereafter, the negative electrode 1 in which the terminal leg portions 12*a* and 12*b* and the supporting leg portions 13*a* and 13*b* are fixed to the fixing portions 14*a* to 14*d* is arranged at a predetermined position of the X-ray tube device 100, thereby completing the X-ray tube device 100.

Effects of Production Method of First Embodiment

In the first embodiment, the following effects can be obtained.

In the first embodiment, as described above, a step of adjusting the heat transfer coefficient between the terminal leg portion 12*a*, 12*b* or the supporting leg portion 13*a*, 13*b* and the fixing portion 14*a* to 14*d* is included. In the step, the fixing portions 14*a* to 14*d* are deformed by applying pressure to the respective fixing portions 14*a* to 14*d* from the outside thereof so that the pressure with respect to at least one leg portion among the plurality of leg portions (terminal leg portions 12*a* and 12*b*, supporting leg portions 13*a* and 13*b*) inserted in the respective recesses 15*a* to 15*d* of the fixing portions 14*a* to 14*d* is different from the pressure with respect to the other leg portions to thereby adjust the heat transfer coefficient between the terminal leg portion 12*a*, 12*b* or the supporting leg portion 13*a*, 13*b* and the fixing portion 14*a* to 14*d*.

With this, similarly to the effects of the structure of the first embodiment, the heat transfer coefficient between the terminal leg portion 12*a*, 12*b* or the supporting leg portion 13*a*, 13*b* and the fixing portion 14*a* to 14*d* is adjusted by differentiating the joint strengths with respect to the terminal leg portions 12*a* and 12*b* and the supporting leg portions 13*a* and 13*b*. Therefore, the deviation of the temperature distribution of the electron emitting portion 11 can be reduced.

As a result, while diversifying the kinds of materials of the usable fixing portions, independently from devising the shape of the electron emitting portion 11 and reducing the cross-sectional areas of the terminal leg portions 12*a* and 12*b* and the supporting leg portions 13*a* and 13*b*, the deviation of the temperature distribution of the electron emitting portion 11 can be reduced.

Further, in the first embodiment, as described above, the step of adjusting the heat transfer coefficient between the terminal leg portion 12*a*, 12*b* or the supporting leg portion 13*a* and 13*b* and the fixing portion 14*a* to 14*d* includes a step of adjusting the heat transfer coefficient between the terminal leg portion 12*a*, 12*b* or the supporting leg portion 13*a*, 13*b* and the fixing portion 14*a* to 14*d* by making the pressure with respect to the leg portion extending from the vicinity of the portion of the electron emitting portion 11 having a relatively high temperature larger than the pressure with respect to the leg portion extending from the vicinity of the portion of the electron emitting portion 11 having a relatively low temperature in the temperature distribution of the electron emitting portion 11 before inserting the terminal leg portions 12*a* and 12*b* and the supporting leg portions 13*a* and 13*b*.

With this, it is possible to make the heat transfer coefficient between the leg portion extending from the vicinity of the portion of the electron emitting portion 11 having a relatively high temperature and the fixing portion 14*a* to 14*d* larger than the heat transfer coefficient between the leg portion extending from the vicinity of the portion of the electron emitting portion 11 having a relatively low temperature and the fixing portion 14*a* to 14*d*. With this, the temperature of the portion of the electron emitting portion 11 having a relatively high temperature can be lowered, and therefore the deviation of the temperature distribution of the electron emitting portion 11 can be reduced effectively.

Further, in the first embodiment, as described above, the recesses 15*a* to 15*d* of the fixing portions 14*a* to 14*d* are each formed in a slit shape penetrating in a direction intersecting with a direction along which the terminal leg portion 12*a*, 12*b*, the supporting leg portion 13*a*, 13*b* is inserted. The step of inserting the terminal leg portions 12*a* and 12*b* and the supporting leg portions 13*a* and 13*b* includes a step of inserting the terminal leg portions 12*a* and 12*b* and the supporting leg portions 13*a* and 13*b* into the respective slit-like recesses 15*a* to 15*d* of the fixing portions 14*a* to 14*d*.

With this, unlike a recess not penetrating in a direction intersecting with a direction along which the leg portion is inserted, the insertions of the terminal leg portions 12*a* and 12*b* and the supporting leg portions 13*a* and 13*b* into the respective recesses 15*a* to 15*d* become easy and the deformations of the fixing portions 14*a* to 14*d* can be performed easily.

In the first embodiment, as described above, the terminal leg portions 12*a* and 12*b* for energizing the electron emitting portion 11 and the supporting leg portions 13*a* and 13*b* provided separately from the terminal leg portions 12*a* and 12*b* to support the electron emitting portion 11 are provided.

Pressure is applied to the terminal leg portions 12*a* and 12*b* and the supporting leg portions 13*a* and 13*b* from the outside thereof so that the pressure with respect to at least one of the terminal leg portions 12*a* and 12*b* and the supporting leg portions 13*a* and 13*b* inserted in the recesses 15*a* to 15*d* of the fixing portion 14*a* to 14*d* becomes different from the pressure with respect to the other leg portions to deform the fixing portions 14*a* to 14*d* to thereby fix the respective terminal leg portions 12*a* and 12*b* and the supporting leg portions 13*a* and 13*b* to the fixing portions 14*a* to 14*d*. Thus, the heat transfer coefficient between the terminal leg portion 12*a*, 12*b* or the supporting leg portion 13*a*, 13*b* and the fixing portion 14*a* to 14*d* is adjusted.

With this, the deviation of the temperature distribution of the electron emitting portion 11 can be adjusted also by the supporting leg portions 13*a* and 13*b* in addition to the terminal leg portions 12*a* and 12*b*, and therefore the deviation of the temperature distribution of the electron emitting portion 11 can be further reduced.

Experiment

Next, with reference to FIGS. 3 to 6, experiments for confirming the relationship between the pressure (joint strength) for fixing the terminal leg portions 12*a* and 12*b* and the supporting leg portions 13*a* and 13*b* to the respective fixing portions 14*a* to 14*d* and the heat transfer coefficient will be described.

Figure 3:
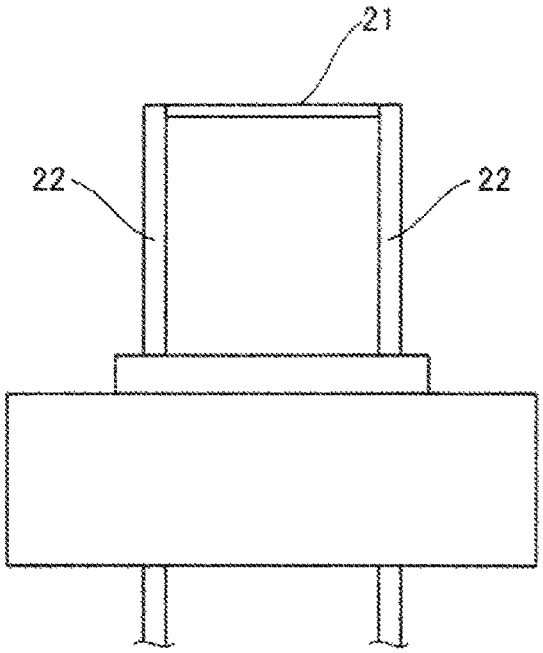
FIG. 3 is a side view showing a tungsten plate and a fixing portion used in experiments for confirming the relationship between a joint strength (pressure) and a heat transfer coefficient.
Figure 4:
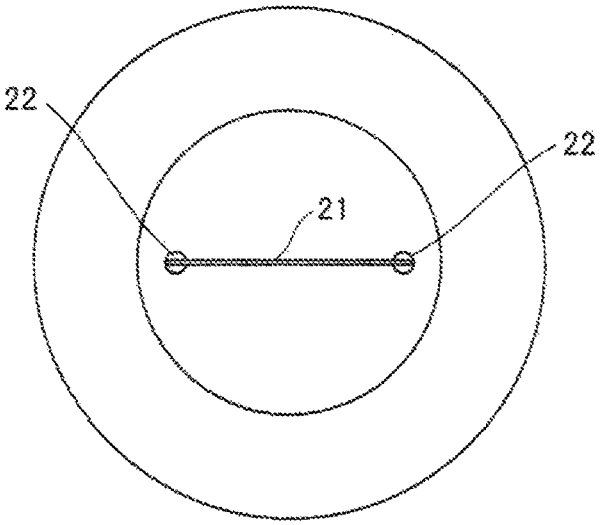
FIG. 4 is a top view showing the tungsten plate and the fixing portion used in experiments for confirming the relationship between the joint strength (pressure) and the heat transfer coefficient.

As shown in FIGS. 3 and 4, in a state in which the tungsten plate 21 is inserted into the slit 23 (see FIG. 5) of the fixing portion 22 made of molybdenum, pressure is applied to the fixing portion 22 to deform the fixing portion 22 to thereby fix the tungsten plate 21 to the fixing portion 22.

In this experiment, a sample in which pressure of 0.4 M[Pa] is applied to the fixing portion 22 to fix the tungsten plate 21 to the fixing portion 22 and a sample in which pressure of 0.6 M[Pa] is applied to the fixing portion 22 to fix the tungsten plate 21 to the fixing portion 22 were prepared.

Figures 5, 6:
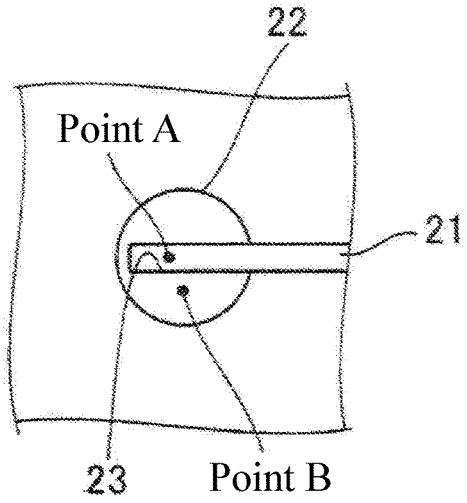
FIG. 5 is an enlarged top view of FIG. 4.
FIG. 6 is a diagram showing results of experiments for confirming the relationship between the joint strength (pressure) and the heat transfer coefficient.

Then, as shown in FIG. 5, electricity is applied to the fixing portion 22 of each sample to heat the tungsten plate 21, and the temperature of the portion (point A) of the tungsten plate 21 inserted into the slit 23 and the temperature of the portion (B point) of the fixing portion 22 in the vicinity of the slit 23 were measured.

As shown in FIG. 6, as a result of energization, in the sample in which the tungsten plate 21 is fixed by the pressure of 0.4 M[Pa], it is confirmed that the current is 15 A, the voltage is 2.29 V, the temperature at the point A was 1,960 K, and the temperature at the point B was 1,381 K. That is, the temperature difference between the point A and the point B is found to be 579 [K].

Further, in the sample in which the tungsten plate 21 is fixed by the pressure of 0.6 M[Pa], it is confirmed that the current is 21 A, the voltage is 4.22 V, the temperature at the point A is 1,932 K, and the temperature at the point B is 1,682 K. That is, the temperature difference between the point A and the point B is found to be 250 [K].

As a result, it is confirmed that the heat transfer coefficient between the tungsten plate 21 and the fixing portion 22 depends on the pressure for fixing the tungsten plate 21. Specifically, it is confirmed that the heat transfer coefficient is increased by increasing the pressure (joint strength) for fixing the tungsten plate 21.

Second Embodiment

Next, referring to FIG. 2, the negative electrode 31 (X-ray tube device 101, see FIG. 1) according to a second embodiment of the present invention will be described.

In the second embodiment, unlike the first embodiment in which the fixing portions 14*a* to 14*d* are made of the same material, one of the fixing portions 34*a* to 34*d* is different in material from the other materials. The same reference numerals are allotted to the same configurations as those of the first embodiment, and the description thereof will be omitted.

As shown in FIG. 2, in the negative electrode 31 (X-ray tube device 101) according to the second embodiment, the heat transfer coefficient between the terminal leg portion 12*a*, 12*b* or the supporting leg portion 13*a*, 13*b* and the fixing portion 34*a* to 34*d* is adjusted by fixing the terminal leg portions 12*a* and 12*b* and the supporting leg portions 13*a* and 13*b* to the fixing portions 34*a* to 34*d* in which at least one of the fixing portions 34*a* to 34*d* is different in material from the other fixing portions 34*a* to 34*d*.

Specifically, the fixing portions 34*a* to 34*d* are configured so that the material is different from each other. For example, the fixing portions 34*a* to 34*d* are made of molybdenum, tungsten, rhenium, and tantalum, respectively. That is, the materials of the fixing portions 34*a* to 34*d* are differentiated and therefore the heat transfer coefficient is different for each material. As a result, the heat transfer coefficient between the terminal leg portion 12*a*, 12*b* or the supporting leg portion 13*a*, 13*b* and the fixing portion 34*a*, 34*d* can be adjusted.

The heat transfer coefficient of each metal at 300 K is as follows: the heat transfer coefficient of tungsten is 173 W/(m·K), the heat transfer coefficient of molybdenum is 138 W/(m·K), the heat transfer coefficient of tantalum is 57.5 W/(m·K), and the heat transfer coefficient of rhenium is 48 W/(m·K) in the descending order. In the temperature distribution of the electron emitting portion 11 before inserting the leg portion into the recesses 35*a* to 35*d* of the fixing portions 34*a* to 34*d*, the material of the fixing portion is selected so that the heat transfer coefficient of the fixing portion with respect to the leg portion extending from the vicinity of the portion of the electron emitting portion 11 having a relatively high temperature becomes larger than the heat transfer coefficient of the fixing portion with respect to the leg portion extending from the vicinity of the portion of the electron emitting portion 11 having a relatively low temperature.

As an example, tungsten is used for a fixing portion with respect to the leg portion extending from the vicinity of the portion of the electron emitting portion 11 having a high temperature, and tantalum is used for the other fixing portions with respect to the leg portions extending from the vicinity of the portion of the electron emitting portion 11 having a low temperature. In the same manner as in the first embodiment, the pressure with respect to at least one of the terminal leg portions 12*a* and 12*b* and the supporting leg portions 13*a* and 13*b* inserted in the recesses 35*a* to 35*d* of the fixing portions 34*a* to 34*d* may be differentiated from the pressure with respect to the other leg portions, or may be the same.

Other configurations of the second embodiment are the same as those of the first embodiment.

Effects of the Second Embodiments

In the second embodiment, the following effects can be obtained.

In the second embodiment, as described above, the heat transfer coefficient between the terminal leg portion 12*a*, 12*b* or the supporting leg portion 13*a*, 13*b* and the fixing portion 34*a* and 34*d* is adjusted by fixing the terminal leg portions 12*a* and 12*b* and the supporting leg portions 13*a* and 13*b* to the fixing portions 34*a* to 34*d* in which at least one of the fixing portions 34*a* to 34*d* is different in material from the other fixing portions 34*a* to 34*d*.

With this, since the deviation of the temperature distribution of the electron emitting portion 11 can be adjusted by the material of the fixing portions 34*a* to 34*d*, the deviation of the temperature distribution of the electron emitting portion 11 can be effectively reduced.

Third Embodiment

Next, with reference to FIG. 7, the negative electrode 41 (X-ray tube device 102, see FIG. 1) according to a third embodiment of the present invention will be described. In the third embodiment, unlike the first embodiment in which the fixing portions 14*a* to 14*d* have the same shape, at least one of the fixing portions 44*a* to 44*d* is different in shape from the other portions. The same reference numerals are allotted to the same configurations as those of the first embodiment, and the description thereof will be omitted.

Figure 7:
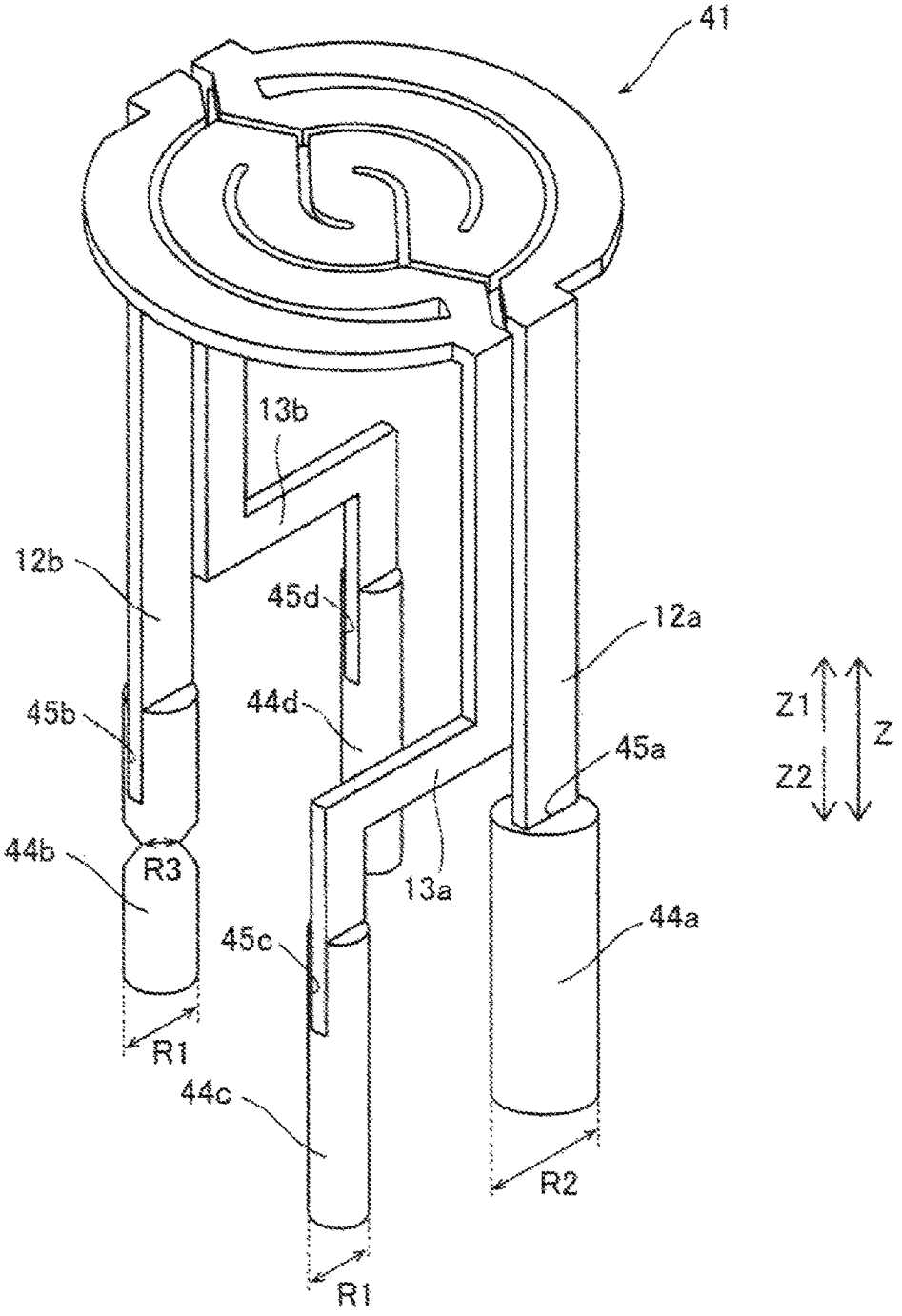
FIG. 7 is a perspective view of a negative electrode according to a third embodiment of the present invention.

As shown in FIG. 7, in the negative electrode 41 (X-ray tube device 102) according to the third embodiment, the terminal leg portions 12*a* and 12*b* and the supporting leg portions 13*a* and 13*b* are fixed to the fixing portions 44*a* to 44*d* in which at least one of the fixing portions 44*a* to 44*d* is different in shape from the other fixing portions. By differentiating the shape of at least one of the fixing portions 44*a* to 44*d* from the shapes of the other fixing portions, at least one fixing portion can be differentiated in heat flux from the other fixing portions.

As a result, the temperature distribution of the electron emitting portion 11 can be made uniform. Specifically, the fixing portions 44*c* and 44*d* each have a cylindrical shape with a diameter R1. Further, the fixing portion 44*a* has a cylindrical shape having a diameter R2 (R1<R2). The fixing portion 44*b* has a shape in which the diameter R3 of the central portion is smaller than the diameter R1 of the other portion.

In the same manner as in the first embodiment, the pressure with respect to at least one of leg portion among the terminal leg portions 12*a* and 12*b* and the supporting leg portions 13*a* and 13*b* inserted in the recesses 45*a* to 45*d* of the fixing portions 44*a* to 44*d* may be differentiated from the pressure with respect to the other leg portions, or may be made the same.

Other configurations of the third embodiment are the same as those of the first embodiment.

Effects of the Third Embodiments

In the third embodiment, the following effects can be obtained.

In the third embodiment, as described above, by fixing the terminal leg portions 12*a* and 12*b* and the supporting leg portions 13*a* and 13*b* to the fixing portions 44*a* to 44*d* in which at least one of the fixing portions 44*a* to 44*d* is different in shape from the other fixing portions, the deviation of the temperature distribution of the electron emitting portion 11 can be adjusted. Therefore, the deviation of the temperature distribution of the electron emitting portion 11 can be reduced more effectively.

Fourth Embodiment

Figure 8:
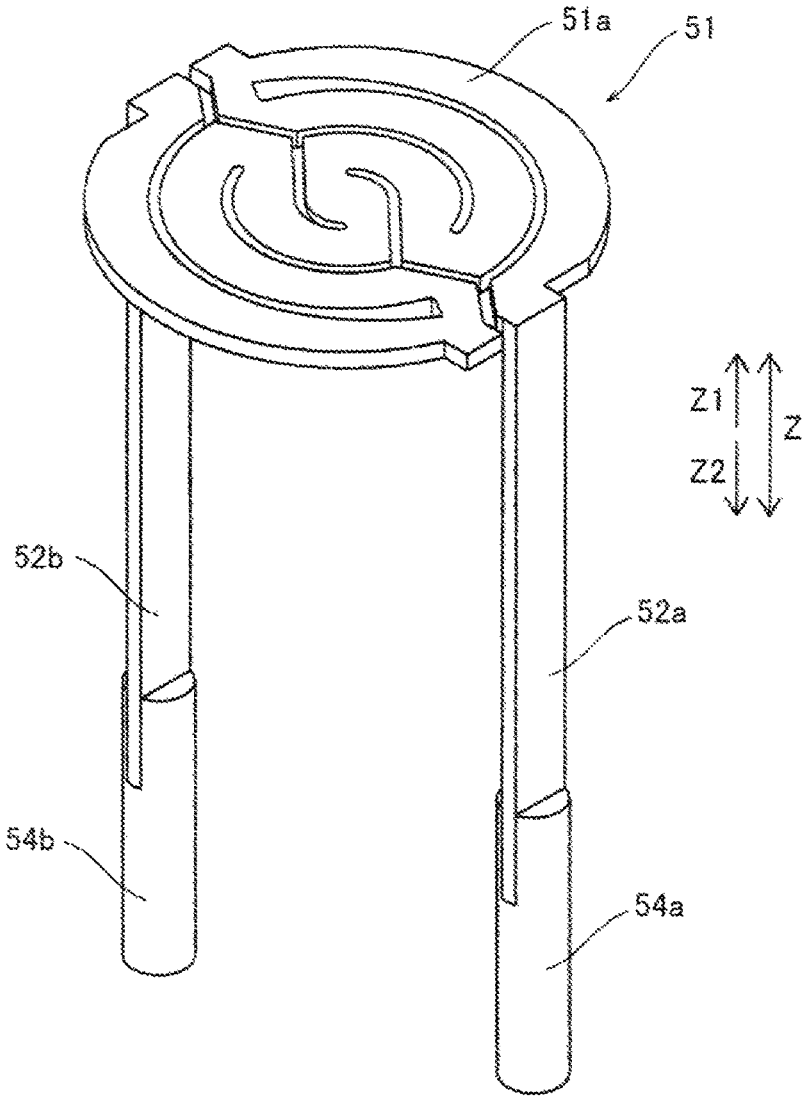
FIG. 8 is a perspective view of a negative electrode according to a fourth embodiment of the present invention.

Next, with reference to FIG. 8, the negative electrode 51 (X-ray tube device 103, see FIG. 1) according to a fourth embodiment of the present invention will be described. In the fourth embodiment, unlike the first embodiment in which the terminal leg portions 12*a* and 12*b* and the supporting leg portions 13*a* and 13*b* are provided, only the terminal leg portions 52*a* and 52*b* are provided. The same reference numerals are allotted to the same configurations as those of the first embodiment, and the description thereof will be omitted. Further, the terminal leg portion 52*a* and 52*b* is an example of the "leg portion" recited in claims.

The negative electrode 51 is made of pure tungsten or a tungsten alloy, and is integrally provided with a flat electron emitting portion 51*a* and a pair of terminal leg portions 52*a* and 52*b*. Further, the terminal leg portions 52*a* and 52*b* are fixed to the fixing portions 54*a* and 54*b*, respectively. The fixing portions 54*a* and 54*b* have the same shape and are made of the same material (for example, molybdenum).

Here, in the fourth embodiment, it is configured such that the joint strength (pressure) of the terminal leg portion 52*a* with respect to the fixing portion 54*a* is differentiated from the joint strength (pressure) of the terminal leg portion 52*b* with respect to the fixing portion 54*b*.

Other configurations and effects of the fourth embodiment are the same as those of the first embodiment.

Modified Embodiment

It should be understood that the embodiments and examples disclosed here are examples in all respects and are not restrictive. The scope of the present invention is shown by the scope of the claims rather than the descriptions of the embodiments and the examples described above, and includes all changes (modifications) within the meaning of equivalent and the scope of claims.

For example, in the first to fourth embodiments, examples are shown in which the pressure with respect to a plurality of leg portions (terminal leg portions, supporting leg portions) are differentiated from each other, but the present invention is not limited thereto. In the present invention, the pressure with respect to at least one leg portion among a plurality of leg portions may be differentiated from the pressure with respect to the other leg portions.

Also, in the first to fourth embodiments, an example is shown in which the recesses of the plurality of fixing portions are each formed in a slit shape penetrating in a direction intersecting with a direction along which a leg portion (terminal leg portion, supporting leg portion) is inserted. However, the present invention is not limited to the example. For example, the recesses of the plurality of fixing portions may be each formed in a hole shape not penetrating in a direction intersecting with a direction along which the leg portion (terminal leg portion, supporting leg portion) is inserted.

Further, in the first to third embodiments, an example is shown in which a pair of supporting leg portions is provided in the negative electrode, but the present invention is not limited thereto. For example, one supporting leg portion may be provided in the negative electrode or three or more supporting leg portions may be provided in the negative electrode.

In the third embodiment, the two fixing portions among the four fixing portions are differentiated in shape from the other two fixing portions. However, the present invention is not limited thereto. In the present invention, it is enough that at least one of the plurality of fixing portions is differentiated in shape from the other fixing portions.

In the second embodiment, an example is shown in which the plurality of fixing portions are differentiated in material from each other. In the third embodiment, an example is shown in which the plurality of fixing portions are differentiated in shape. However, the present invention is not limited thereto. For example, the materials of a plurality of fixing portions and the shapes of a plurality of fixing portions may be differentiated from each other.

In the first to fourth embodiments, an example is shown in which the terminal leg portions and the supporting leg portions are each formed in a plate shape, but the present invention is not limited thereto. In the present invention, the terminal leg portions and the supporting leg portions may have a shape other than a plate shape.

In the first to fourth embodiments, an example is shown in which the fixing portion is formed in a cylindrical shape, but the present invention is not limited thereto. For example, the fixing portion may be formed in a shape (for example, a rectangular parallelepiped shape, a bent shape, etc.) other than a columnar shape.

In the first to fourth embodiments, the negative electrode of the present invention is applied to the X-ray tube device, but the present invention is not limited thereto. For example, the negative electrode of the present invention may be applied to devices (such as a heater) other than an X-ray tube device.

In the first to fourth embodiments, the example is shown in which the heat transfer coefficient is adjusted so as to reduce the deviation of the temperature distribution of the electron emitting portion, but the present invention is not limited thereto. For example, the present invention can also be applied to a case in which it is desired to deliberately increase the deviation of the temperature distribution of the electron emitting portion.

The invention claimed is:

1. A negative electrode comprising:

an electron emitting portion configured to emit electrons by electric heating;

a plurality of leg portions extending from the electron emitting portion; and a plurality of metallic fixing portions each having a recess into which the leg portion is inserted and joined, wherein a joint strength of at least one of the leg portions with respect to the fixing portion is different from joint strengths of the other leg portions with respect to the fixing portions, and at least one of the leg portions and the other leg portions are different in heat transfer coefficient between the leg portion and the fixing portion.

2. A negative electrode comprising:

an electron emitting portion configured to emit electrons by electric heating;

a plurality of leg portions extending from the electron emitting portion; and a plurality of metallic fixing portions each having a recess into which the leg portion is inserted and joined, wherein at least one of the fixing portions is different in material from the other fixing portions, and at least one of the fixing portions and the other fixing portions are different in heat transfer coefficient between the leg portion and the fixing portion.

3. An X-ray tube device comprising:

a positive electrode; and a negative electrode, wherein the negative electrode includes a plurality of leg portions extending from the electron emitting portion and a plurality of metallic fixing portions each having a recess into which the leg portion is inserted and joined, and at least one of the fixing portions is different in material from the other fixing portions, and at least one of the fixing portions and the other fixing portions are different in heat transfer coefficient between the leg portion and the fixing portion.

* * * * *